US007423504B2

(12) United States Patent
Kon et al.

(10) Patent No.: US 7,423,504 B2
(45) Date of Patent: Sep. 9, 2008

(54) ELECTROMAGNETIC RELAY

(75) Inventors: Hiroyuki Kon, Iwate (JP); Masayuki Morimoto, Iwate (JP)

(73) Assignee: NEC Tokin Corporation, Miyagi (JP)

( * ) Notice: Subject to any disclaimer, the term of this patent is extended or adjusted under 35 U.S.C. 154(b) by 0 days.

(21) Appl. No.: 11/401,347

(22) Filed: Apr. 11, 2006

(65) Prior Publication Data

US 2006/0226935 A1 Oct. 12, 2006

(30) Foreign Application Priority Data

Apr. 12, 2005 (JP) ..... 2005-114584

(51) Int. Cl.
*H01H 63/02* (2006.01)
*H01H 67/02* (2006.01)

(52) U.S. Cl. ..... 335/133; 335/78; 335/79; 335/80; 335/128; 335/129; 335/130; 335/131; 335/132; 335/133

(58) Field of Classification Search ..... 335/78–80, 335/128–132
See application file for complete search history.

(56) References Cited

U.S. PATENT DOCUMENTS 2,490,280 A * 12/1949 Rees ..... 335/193
2,671,836 A * 3/1954 Anger et al. ..... 335/261
2,731,527 A * 1/1956 Marsh ..... 335/125
2,805,301 A * 9/1957 Shaw ..... 335/125
2,976,379 A * 3/1961 Rhodes ..... 335/125
3,155,804 A * 11/1964 Stanley ..... 200/266
3,242,283 A * 3/1966 Clements ..... 335/188
3,272,949 A * 9/1966 Lawrence ..... 200/243
3,317,869 A * 5/1967 Funke ..... 335/154
3,344,373 A * 9/1967 Janninck ..... 335/49
3,866,092 A * 2/1975 Burns ..... 361/2
3,974,468 A * 8/1976 Ygfors ..... 335/151
4,216,358 A * 8/1980 Brozille ..... 200/447
4,401,863 A * 8/1983 Lemmer et al. ..... 200/16 A
4,421,959 A * 12/1983 Chen et al. ..... 200/16 A
4,453,057 A * 6/1984 Streich et al. ..... 200/243
4,551,660 A * 11/1985 Suzuki ..... 318/293
4,640,998 A * 2/1987 Sorenson ..... 200/457
4,650,935 A * 3/1987 Ootsuka et al. ..... 200/16 A (Continued)

FOREIGN PATENT DOCUMENTS

AU 499 732 B2 5/1979

(Continued)

OTHER PUBLICATIONS

The extended European Search Report issued by the European Patent Office onOct. 10, 2007, pp. 1 to 7.

(Continued)

*Primary Examiner*—Elvin Enad
*Assistant Examiner*—Mohamad A Musleh
(74) *Attorney, Agent, or Firm*—Whitham, Curtis, Christofferson & Cook, PC

(57) ABSTRACT

An electromagnetic relay is provided which is capable of reducing a contact bounce at time of closing a contact. The electromagnetic relay is so configured that an opposed angle θ is 0°<θ<45°, when viewed from a direction to which a normally open fixed contact and a movable contact slide before the normally open fixed contact comes into surface-contact with the movable contact spring.

1 Claim, 8 Drawing Sheets

U.S. PATENT DOCUMENTS

| | | | | | |
|---|---|---|---|---|---|
| 4,876,493 | A | * | 10/1989 | Suzuki | 318/293 |
| 4,947,146 | A | * | 8/1990 | Ichimura et al. | 335/131 |
| RE33,457 | E | * | 11/1990 | Ootsuka et al. | 200/16 A |
| 5,049,845 | A | * | 9/1991 | Yokoyama et al. | 335/133 |
| 5,329,163 | A | * | 7/1994 | Satoh et al. | 307/10.1 |
| 5,572,176 | A | * | 11/1996 | Heinzl et al. | 335/129 |
| 5,757,255 | A | * | 5/1998 | Noda et al. | 335/78 |
| 5,831,502 | A | * | 11/1998 | Kirsch | 335/129 |
| 6,084,488 | A | * | 7/2000 | Macbeth et al. | 335/132 |
| 6,300,854 | B1 | * | 10/2001 | Oberndorfer | 335/196 |
| 6,837,729 | B2 | * | 1/2005 | Hogue et al. | 439/289 |
| 2004/0048521 | A1 | | 3/2004 | Hogue et al. | 439/775 |

FOREIGN PATENT DOCUMENTS

| | | | |
|---|---|---|---|
| DE | 91 17 155 | U1 | 8/1991 |
| DE | 198 58 755 | C1 | 12/1998 |
| EP | 0 326 116 | A1 | 1/1989 |
| JP | S51-148646 | | 5/1950 |
| JP | 2-18218 | | 2/1990 |
| JP | 3-58818 | | 6/1991 |
| JP | 3-124450 | | 12/1991 |
| JP | 5-120971 | | 5/1993 |
| JP | 5-83994 | | 11/1993 |
| JP | 06267390 | A * | 9/1994 |
| JP | 9-129108 | | 5/1997 |
| JP | 2001-23496 | | 1/2002 |
| JP | 2002-8506 | | 1/2002 |

OTHER PUBLICATIONS

The Office Action issued by the South Korea Patent Office on Dec. 20, 2007, with Japanese and English language translations, pp. 1 to 8.
An Office Action issued by the Japanese Patent Office on Jan. 23, 2008, with an English language translation, pp. 1-3.
The Office Action with English language translation issued by the Japanese Patent Office on Sep. 19, 2007, pp. 1 to 3.
Office Action issued by the Japanese Patent Office on Jun. 4, 2008, in relation to corresponding Japanese patent Application with English language translation, pp. 1 to 6.

* cited by examiner

ELECTROMAGNETIC RELAY

BACKGROUND OF THE INVENTION

1. Field of the Invention

The present invention relates to an electromagnetic relay and more particularly to the electromagnetic relay to be used as a vehicle-mounted electromagnetic relay or a like.

The present application claims priority of Japanese Patent Application No. 2005-114584 filed on Apr. 12, 2005, which is hereby incorporated by reference.

2. Description of the Related Art

Conventionally, an electromagnetic relay is used for electrical components of automobiles or a like. The general and conventional electromagnetic relay being used as a vehicle-mounted one is described below.

FIG. 1 is a perspective view showing configurations of a conventional electromagnetic relay 10. FIG. 2 is partially exploded perspective view showing configurations of the conventional electromagnetic relay 10 of FIG. 1. FIG. 3 is a partial side view showing configurations of the conventional electromagnetic relay 10 of FIG. 1. As shown in FIG. 1, on a base 7 is mounted a coil 1 on which a movable contact 3*a* is placed with a yoke 2 and an armature 4 being interposed between the coil 1 and movable contact 3*a*. As shown in FIG. 2, the electromagnetic relay 10 operates in a manner in which an end of its movable contact spring 3 serves as the movable contact 3*a* which alternately comes in contact with a normally closed fixed contact 5*a* of a normally closed fixed contact member 5 placed so as to face the movable contact 3*a* and a normally open fixed contact 6*a* of a normally open fixed contact member 6 also placed so as to face the movable contact 3*a*.

Moreover, the movable contact spring 3 is in contact with the armature 4 with a spool 8 and an iron core 9 being interposed between the movable contact spring 3 and the armature 4.

In FIGS. 1 to 3, when a voltage is applied to the coil 1, the movable contact spring 3 and the movable contact 3*a* move toward a direction A (FIG. 3) and, when striking the normally open fixed contact 6*a* to come into physical contact on surfaces of the movable contact 3*a* and the normally open fixed contact 6*a*, the movable contact spring 3 bends with attractive magnetic forces and the movable contact 3*a* slides on the normally open fixed contact 6*a* toward a direction B (FIG. 3).

FIGS. 8A and 8B are partial side views explaining operations of the movable contact 3*a*, normally closed fixed contact 5*a*, and normally open fixed contact 6*a* when viewed from a direction to which the contact slides (same as the direction B in FIG. 3) in the conventional electromagnetic relay 10. FIG. 8A shows operations in a non-excited state and FIG. 8B shows operations in an excited state. As shown in FIG. 8A, in the conventional electromagnetic relay 10, when a voltage is applied to its coil 1 shown in FIGS. 1 and 2, the movable contact 3*a* strikes the normally open fixed contact 6*a* and slides thereon. An angle which a surface of the movable contact 3*a* being opposed to the normally open fixed contact 6*a*, when viewed from the direction to which the movable contact 3*a* slides on the normally open fixed contact 6*a*, forms with a surface of the normally open fixed contact 6*a* being opposed to the surface of the movable contact 3*a* when viewed from the sliding direction is set to be fixed so that the movable contact 3*a* is parallel to the normally open fixed contact 6*a*. As shown in FIG. 8B, when an voltage is applied to the coil 1 (as shown in FIGS. 1 and 2), the movable contact 3*a* comes into collision with the normally open fixed contact 6*a* and the movable contact 3*a* is moved by repulsion in a manner to become a movable contact 11 shown by dashed lines which is the movable contact 3*a* resulting from the movement. This movement is called a "contact bounce".

Generally, a very large amount of current flows through loads such as a lamp or a capacitor when a contact is closed. Therefore, the above-described contact bounce occurring at the time of closing the contact has much effect on a contact life of the electromagnetic relay 10.

If a contact bounce occurs in a state where a large amount of current is flowing, arc currents are produced and there is a danger of an occurrence of a failure such as welding of a contact or locking caused by a protrusion or hole formed on a contact surface.

In order to decrease the occurrence of the bounce at time of closing the contact, by making stiffness of the fixed contact member lower and by making the fixed contact member itself elastic, repulsion is suppressed at a time of collision of the movable contact, which enables the occurrence of the bounce to be reduced. This technology is disclosed in Patent Reference I (Japanese Utility Model Application Laid-open No. Hei05-83994).

As described above, in the Patent Reference 1, for example, in order to decrease the occurrence of arc currents, an electromagnetic relay is so configured that a fixed contact spring itself is made to have elasticity, however, to make the fixed contact member itself have elasticity, it is necessary to make a plate thickness be small, which causes a decrease in current-carrying capability due to reduction in a cross-sectional area for current carrying. Moreover, if a vibration-isolating material is to be mounted thereon, new problems of an increase in component counts accompanied by an increase in the number of man-hours or in costs arise.

SUMMARY OF THE INVENTION

In view of the above, it is an object of the present invention to provide an electromagnetic relay which is capable of reliably decreasing a contact bounce at time of closing a contact without causing a decrease in current-carrying capability and an increase in component counts.

According to a first aspect of the present invention, there is provided an electromagnetic relay including:

a fixed contact member having a normally closed fixed contact;

a fixed contact member having a normally open fixed contact;

a movable contact spring having a movable contact whose surface is opposed to each of a surface of the normally closed fixed contact and a surface of the normally open fixed contact;

an armature coupled to the movable contact spring; and an iron core around which coils used to attract the armature are wound;

wherein, by interaction between a spring force of the movable contact and a magnetic force generated by an exciting current fed to the coils, either of the normally closed fixed contact or the normally open fixed contact does or does not come into surface-contact with the movable contact and wherein an opposed angle θ when viewed from a direction of sliding of the movable contact and the normally open fixed contact that is induced by bending of the normal contact spring, which the normally open fixed contact forms with the movable contact before either of the normal close contact or the normal open contact comes into surface-contact with the movable contact, is $0° < \theta < 45°$.

In the foregoing aspect, a preferable mode is one wherein the opposed angle θ, when viewed from the direction of sliding of the movable contact and the normally open fixed contact that is induced by bending of the normal contact spring, which the normally open fixed contact forms with the movable contact before either of the normal close contact or the normal open contact comes into surface-contact with the movable contact, is $\theta°<0<20°$.

Also, a preferable mode is one wherein the normally open fixed contact has a plate-shaped surface, and the movable contact has a plate-shaped surface.

Another preferable mode is one wherein the normally open fixed contact is formed to have an inclination angle θ being equal to the opposed angle θ in advance, such that the opposed angle θ, when viewed from the direction of sliding of the movable contact and the normally open fixed contact that is induced by bending of the normal contact spring, which the normally open fixed contact forms with the movable contact before either of the normal close contact or the normal open contact comes into surface-contact with the movable contact, is $0°<\theta<45°$.

Still another mode is one wherein the movable contact is formed to have an inclination angle θ being equal to the opposed angle θ in advance, such that the opposed angle θ, when viewed from the direction of sliding of the movable contact and the normally open fixed contact that is induced by bending of the normal contact spring, which the normally open fixed contact forms with the movable contact before either of the normal close contact or the normal open contact comes into surface-contact with the movable contact, is $0°<\theta<45°$.

By configuring as above, the surface of the plate-shaped normally open fixed contact and the surface of the plate-shaped movable contact are opposed to each other in a manner to form a specified angle and, when the normally open fixed contact comes into surface-contact with the movable contact, after part of one contact portion comes into contact with part of other contact portion, the movable contact is twisted, while sliding on the plate-shaped movable contact due to elasticity of an arm-shaped spring member supporting the movable contact, which causes a residual portion of the contact to come into contact and causes repulsion at a time of collision to be reduced, thus preventing an occurrence of a contact bounce.

With the above configuration, the contact bounce at the time of closing the contact is reduced, which enables the provision of the electromagnetic relay to have a long contact life.

BRIEF DESCRIPTION OF THE DRAWINGS

The above and other objects, advantages, and features of the present invention will be more apparent from the following description taken in conjunction with the accompanying drawings in which:

FIG. 8A shows a non-excited state and FIG. 8B shows an excited state;

DETAILED DESCRIPTION OF THE PREFERRED EMBODIMENTS

Best modes of carrying out the present invention will be described in further detail using various embodiments with reference to the accompanying drawings. According to the present invention, an inclination angle θ which a surface of a movable contact forms with a surface of a normally open fixed contact obtained by making a supporter of at least either of the movable contact or the normally open fixed contact be inclined in advance is preferably $0°<\theta<45°$. Also, the same effect as above can be achieved not by making the supporter be inclined, but by making the contact portion only be inclined so as to have a convex surface. Moreover, the reason why the inclination angle θ is set in the above range is that, if the inclination angle θ is more than 45°, a contact failure occurs. From a viewpoint of wearing-out of the contact, the inclination angle θ is set to be preferably $5°<\theta<20°$.

First Embodiment

Figure 4:
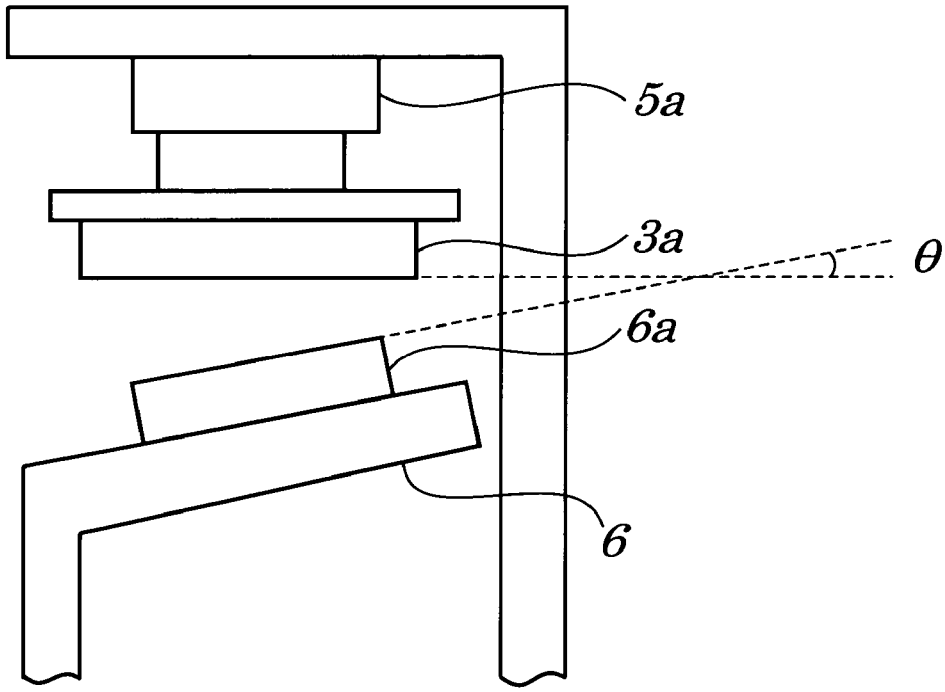
FIG. 4 is a partial side view showing configurations of the electromagnetic relay according to a first embodiment of the present invention.

FIG. 4 is a side view of a contact portion when viewed from a direction to which a movable contact 3*a* slides on a normally open fixed contact 6*a* according to the first embodiment of the present invention. A normally open fixed contact 6*a* is inclined and an inclination angle θ is formed by a surface of the movable contact 3*a* and by a surface of the normally open fixed contact 6*a*. When a voltage is applied to a coil, the surface of the inclined normally open fixed contact 6*a* strikes the surface of the movable contact 3*a* to come into physical contact. At this time point, a movable contact spring 3 bends with attractive magnetic forces, which causes the movable contact 3*a* and the normally open fixed contact 6*a* to slide relatively on each other, and which the movable contact 3*a* is attracted to the normally open fixed contact 6*a*.

Figure 1:
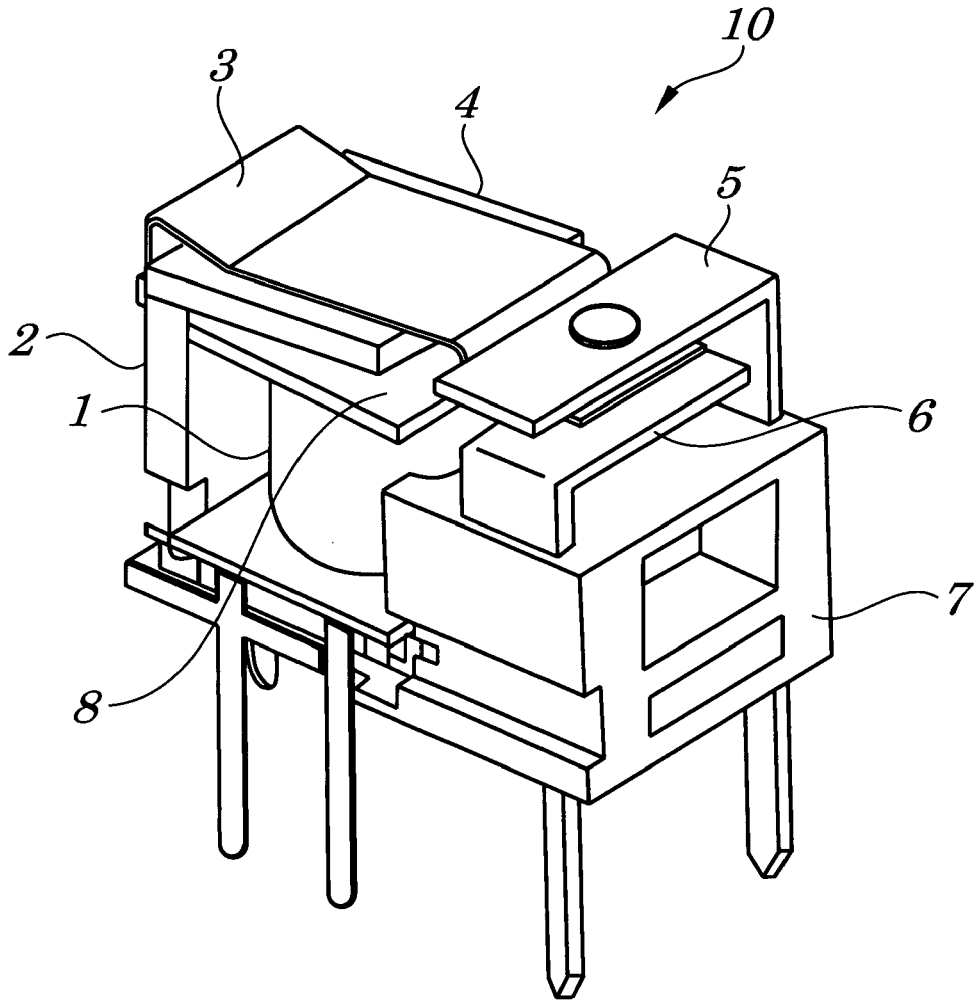
FIG.1 (RELATED ART)
FIG. 1 is a perspective view showing configurations of a conventional electromagnetic relay.
Figure 2:
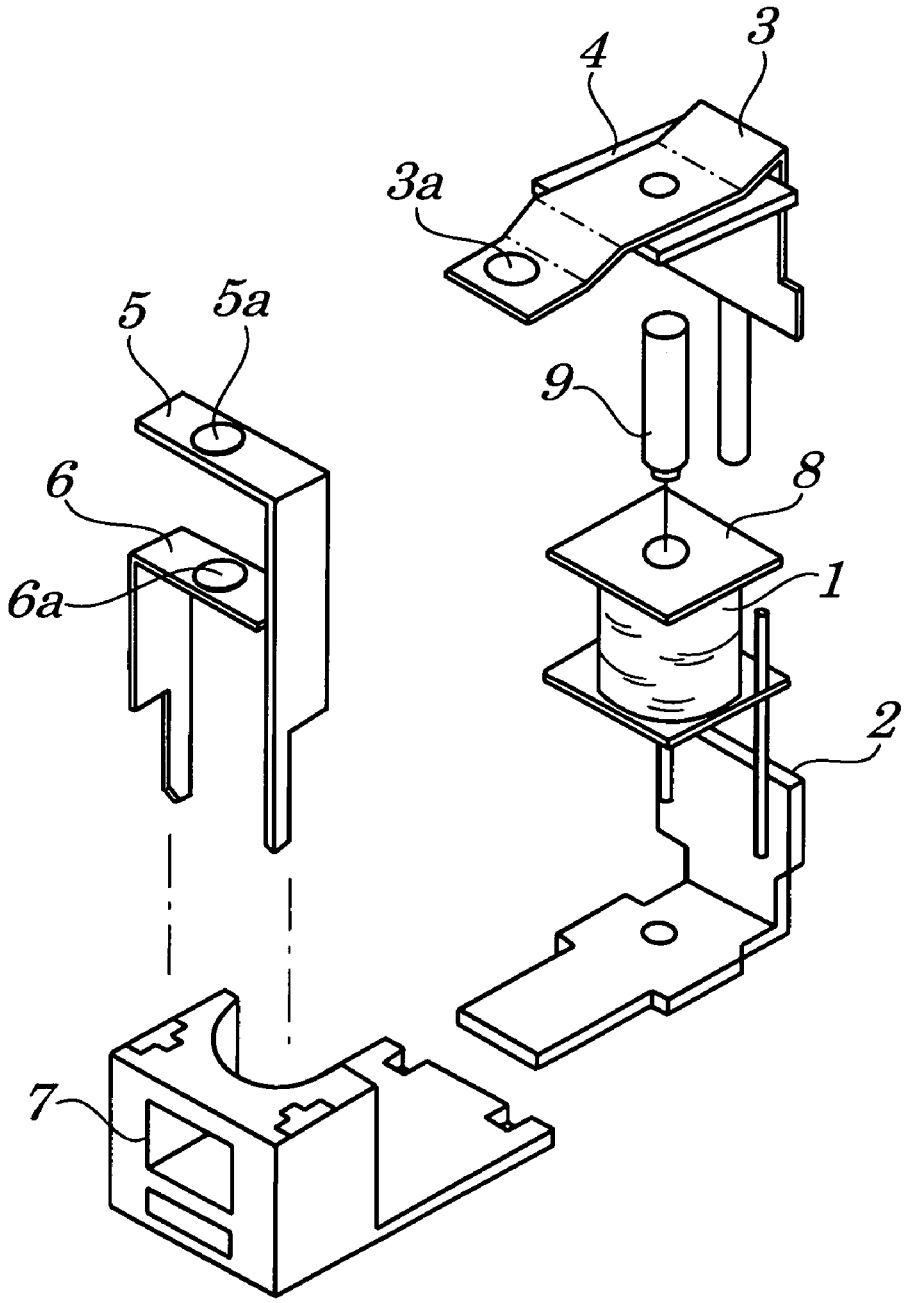
FIG.2 (RELATED ART)
FIG. 2 is a partially exploded perspective view showing configurations of the conventional electromagnetic relay of FIG. 1.
Figure 3:
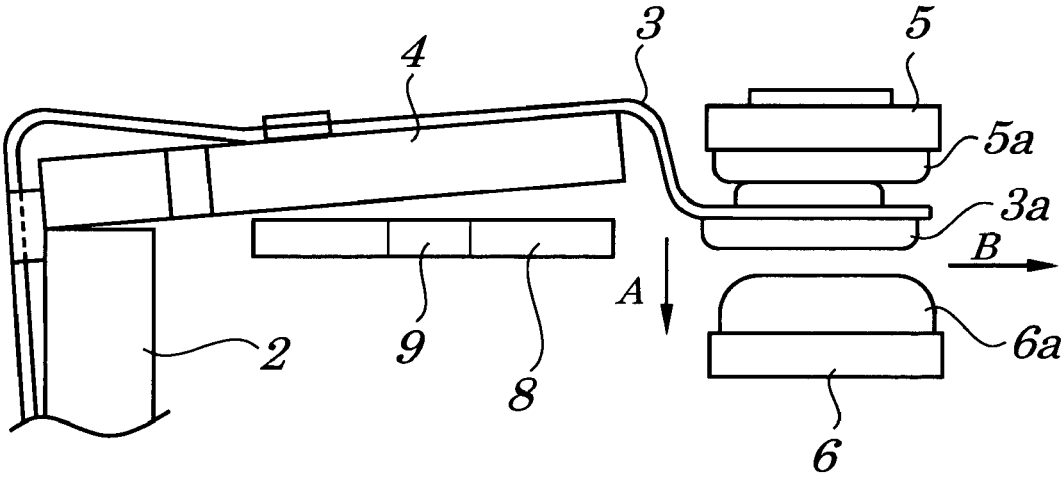
FIG.3 (RELATED ART)
FIG. 3 is a partial side view showing configurations of the conventional electromagnetic relay of FIG. 1.
Figure 7:
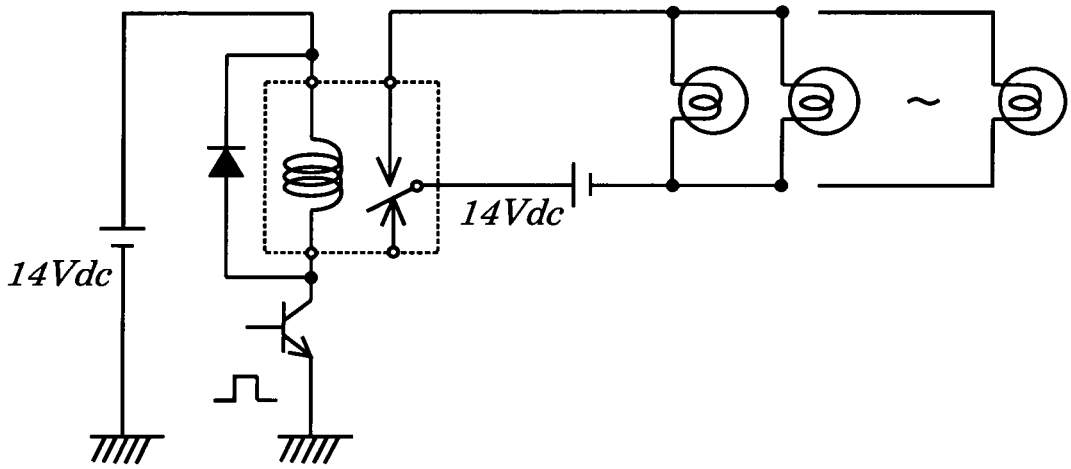
FIG. 7 is a schematic diagram showing an electric circuit to be used in an electrical life test under lamp-loaded conditions on the electromagnetic relay according to the first embodiment of the present invention.
Figure 8A:
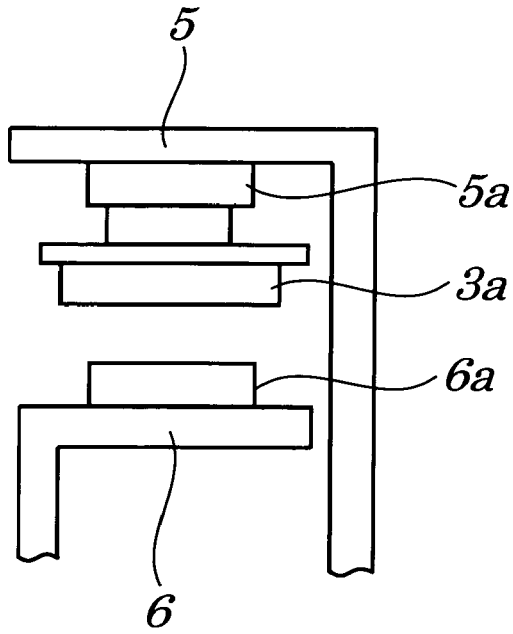
FIG. 8A (RELATED ART)
FIGS. 8A and 8B are partial side diagrams showing the conventional electromagnetic relay.
Figure 8B:
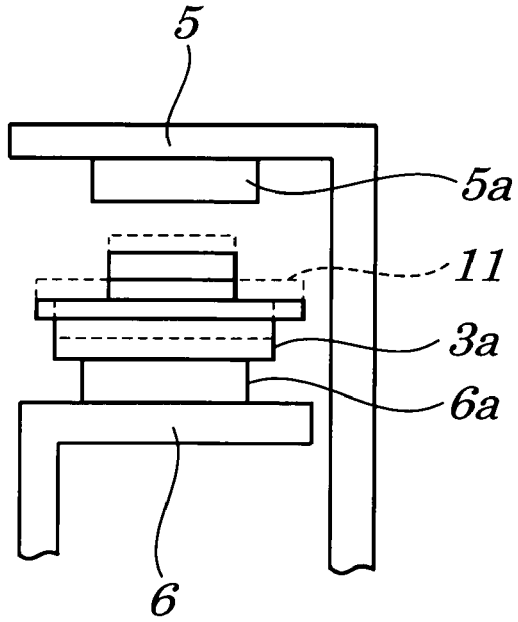
FIG. 8B (RELATED ART)

An electrical life test under lamp-loaded conditions was conducted, using a testing circuit shown in FIG. 7, on an electromagnetic relay having its contact configurations shown in FIG. 4 that was used as a test sample. The inclination angle θ which the surface of the movable contact 3*a* forms with the surface of the normally open fixed contact 6*a* was changed at every 5° from a level of θ=5° (test sample 2) to a level of θ=45° (test sample 10). Ten test samples for each of the above inclination angle levels were prepared. Moreover, for comparison, another electrical life test was conducted, using the same circuit as used in the above test, on a test sample 1 having the conventional contact structure shown in FIG. 3, that is, having its inclination angle θ=0° of a normally open fixed contact 6*a*. In this life test, both a coil voltage and a lamp-loaded voltage were 14 Vdc and the test was conducted in ordinary temperature environments and initial bounce time and the number of times of operations performed before an occurrence of failure were measured to obtain mean values.

Table 1 shows results from the electrical life test.

TABLE 1

| Test Sample | Opposed Angel "θ"(° ) | Initial Bounce Time (ms) | Results from Opposed-angle Level Based Life Test: Electrical Life Test Results, Number of Times of Operation(×10k Times) 1 | 2 | 3 | 4 | 5 | 6 | 7 | 8 | 9 | 10 | Failure Cause |
|---|---|---|---|---|---|---|---|---|---|---|---|---|---|
| Test Sample 1 | 0° | 0.22 | → | → | → | → | X | | | | | | Melting and Adhesion |
| Test Sample 2 | 5° | 0.00 | → | → | → | → | → | → | → | → | → | → | No Problem |
| Test Sample 3 | 10° | 0.00 | → | → | → | → | → | → | → | → | → | → | No Problem |
| Test Sample 4 | 15° | 0.00 | → | → | → | → | → | → | → | → | → | → | No Problem |
| Test Sample 5 | 20° | 0.00 | → | → | → | → | → | → | → | → | → | → | No Problem |
| Test Sample 6 | 25° | 0.00 | → | → | → | → | → | → | → | → | → | → | No Problem |
| Test Sample 7 | 30° | 0.00 | → | → | → | → | → | → | → | → | → | → | No Problem |
| Test Sample 8 | 35° | 0.00 | → | → | → | → | → | → | → | → | → | → | No Problem |
| Test Sample 9 | 40° | 0.00 | → | → | → | → | → | → | → | → | → | → | No Problem |
| Test Sample 10 | 45° | 0.00 | → | → | → | → | → | → | → | X | | | Poor Contract |

As shown in Table 1, the comparison between the conventional example (test sample 1) and samples (test samples 2 to 9) according to the first embodiment of the present invention shows that an initial bounce occurs and the electrical life was only about forty-thousand operations in the conventional example (test sample 1), whereas no initial bounce occurred in the test samples 2 to 9 according to the first embodiment of the present invention. Moreover, even if the number of times of operations exceeds one hundred thousand, no failure occurred. It is assumed that the occurrence of arc currents at the time of closing the contact can be prevented with the configurations of the first embodiment. Also, in the case of the test sample 10, in which the inclination angle θ=45°, though the initial bounce did not occur, when the number of times of operations exceeds seventy-thousand, a failure occurred. This was presumably attributable to a contact failure caused by excessive inclination of the normally open fixed contact 6*a*.

Though not shown in Table 1, when the test samples 2 to 9 were made to operate in a manner to exceed one hundred thousand times of operations, the test samples 2 to 5 showed excellent results in particular. This is presumably not only because the occurrence of arc currents caused by the bounce at time of operations was prevented but also because wearing-out of the contact caused by the occurrence of the arc currents at time of restoration was decreased. Therefore, when the inclination angle θ is more than 0° and is less than 45°, the occurrence of the initial bounce is prevented and the electromagnetic relay having an electrically long life can be obtained. The inclination angle θ is more preferably set to be more than 5° and 20° or less.

Second Embodiment

Figure 5:
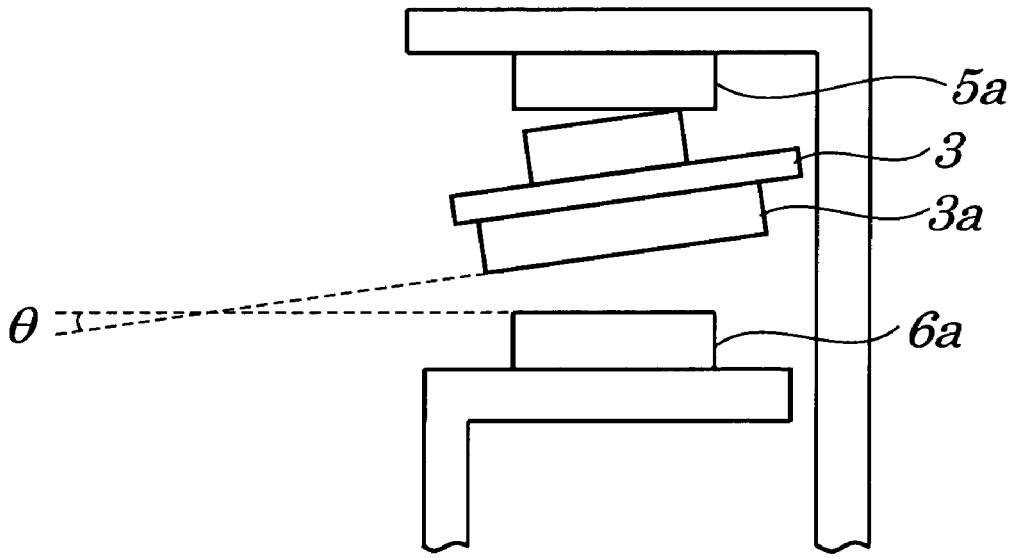
FIG. 5 is a partial side view showing configurations of an electromagnetic relay according to a second embodiment of the present invention.

FIG. 5 is a diagram showing a side face of a contact portion when viewed from a direction to which a movable contact 3*a* slides on a normally open fixed contact 6*a* according to the second embodiment of the present invention. The movable contact 3*a* is inclined and an inclination angle 8 is formed by a surface of the movable contact 3*a* and by a surface of a normally open fixed contact 6*a*. When a voltage is applied to a coil (not shown), the surface of the inclined movable contact 3*a* strikes the surface of the normally open fixed contact 6*a* to come into physical contact. At this time point, a movable contact spring 3 bends with attractive magnetic forces, which causes the movable contact 3*a* to slide on the normally open fixed contact 6*a*, and which the movable contact 3*a* is attracted to the normally open fixed contact 6*a*.

An electrical life test under lamp-loaded conditions was conducted, using a testing circuit shown in FIG. 7, on the electromagnetic relay having its contact configurations shown in FIG. 5 that was used as a test sample. An inclination angle θ which the surface of the movable contact 3*a* forms with the surface of the normally open fixed contact 6*a* was changed at every 5° from a level of θ=5° (test sample 2) to a level of θ=45° (test sample 10). Ten test samples for each of the above inclination angle levels were prepared. Moreover, for comparison, another electrical life test was conducted, using the same circuit as used in the above test, on a test sample 1 having a conventional contact structure shown in FIG. 3, that is, having its inclination angle θ=0° of the normally open fixed contact 6*a*. In this life test, both a coil voltage and a lamp-loaded voltage were 14 Vdc and the test was conducted in ordinary temperature environments and initial bounce time and the number of times of operations performed before an occurrence of failure were measured to obtain mean values.

As a result, almost the same effect obtained in the first embodiment was achieved in the second embodiment. Therefore, when the angle θ which the surface of the movable point 3*a* forms with the surface of the normally open fixed contact 6*a* is more than 0° and is less than 45°, occurrence of an initial bounce is prevented and the electromagnetic relay having an electrically long life can be obtained. The inclination angle θ is more preferably set to be more than 5° and 20° or less.

Third Embodiment

Figure 6:
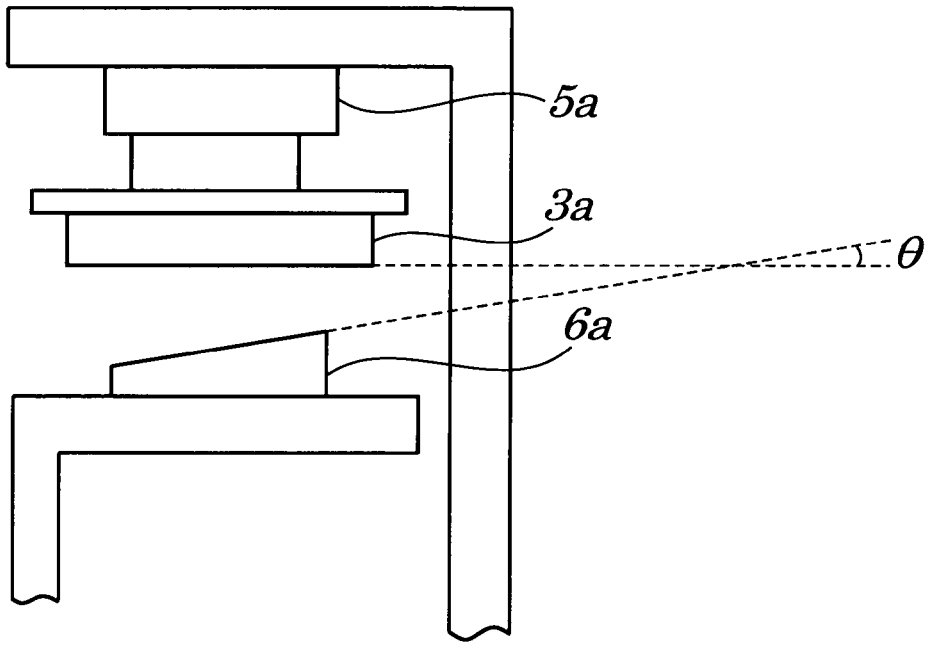
FIG. 6 is a partial side view showing configurations of an electromagnetic relay according to a third embodiment of the present invention.

FIG. 6 is a diagram showing a side face of a contact portion when viewed from a direction to which a movable contact 3*a* slides on a normally open fixed contact 6*a* according to a third embodiment of the present invention. On a normally open fixed contact 6*a* is formed an inclined surface being of a convex shape and having an inclination angle θ. When a voltage is applied to a coil (not shown), the surface of the inclined movable contact 3*a* strikes the surface of the inclined surface of the normally open fixed contact 6*a* to come into physical contact. At this time point, a movable contact spring 3 bends with attractive magnetic forces, which causes the movable contact 3*a* and the normally open fixed contact 6*a* to slide relatively on each other, and which the movable contact 3*a* is attracted to the normally open fixed contact 6*a*.

An electrical life test under lamp-loaded conditions was conducted, using a testing circuit shown in FIG. 7, on an electromagnetic relay having its contact configurations shown in FIG. 6 that was used as a test sample. An inclination angle θ which the surface of the movable contact 3*a* forms with the surface of the normally open fixed contact 6*a* was changed at every 5° from a level of θ=5° to a level of θ=45°. Ten test samples for each of the above inclination angle levels were prepared. Moreover, for comparison, another electrical life test was conducted, using the same circuit as used in the above test, on a test sample 1 having conventional contact structure shown in FIG. 3, that is, having its inclination angle θ=0° of the normally open fixed contact 6*a*. In this life test, both a coil voltage and a lamp-loaded voltage were 14 Vdc and the test was conducted in ordinary temperature environments and initial bounce time and the number of times of operations performed before an occurrence of failure were measured to obtain mean values.

As a result, almost the same effects obtained in the first and second embodiments were achieved in the third embodiment. Therefore, when the inclination angle θ of the inclined surface is more than 0° and is less than 45°, the occurrence of the initial bounce is prevented and the electromagnetic relay having an electrically long life can be obtained. The inclination angle θ is more preferably set to be more than 5° and 20° or less.

Moreover, even in cases other than the above embodiments, if the angle θ which the surface of the movable contact 3*a* forms with the surface of the normally open fixed contact 6*a* is substantially more than 0° and is less than 45°, the occurrence of the initial bounce is prevented and the electromagnetic relay having an electrically long life can be obtained. Moreover, setting the above angle θ to be more than 5° and 20° or less enables the electromagnetic relay having an electrically long life to be achieved.

It is apparent that the present invention is not limited to the above embodiments but may be changed and modified without departing from the scope and spirit of the invention. Additionally, by using the electromagnetic relay of the present invention, it is made possible to increase reliability of automobile parts and/or electrical components using electromagnetic relays.

What is claimed is:

1. An electromagnetic relay comprising:

a fixed contact member having a normally closed fixed contact;

a fixed contact member having a normally open fixed contact;

a movable contact spring having a movable contact whose surface is opposed to each of a surface of said normally closed fixed contact and a surface of said normally open fixed contact, said normally open fixed contact and said movable contact each having opposed plate-shaped surfaces, and the opposed plate-shaped surface of the normally open fixed contact is inclined with respect to the opposed plate-shaped surface of the movable contact at an inclination angle θ;

an armature coupled to said movable contact spring; and an iron core around which coils used to attract said armature are wound;

wherein, by interaction between a spring force of said movable contact and a magnetic force generated by an exciting current fed to said coils, said normally open fixed contact comes into initial physical surface-contact with said movable contact and wherein, due to bending of the contact spring, the movable contact slides relative to the fixed contact which causes a residual portion of the movable contact to come into full surface contact with the fixed contact and causes repulsion at a time of collision to be reduced, thus preventing an occurrence of a contact bounce, and wherein said inclination angle θ, when viewed from a direction of sliding of said movable contact and said normally open fixed contact that is induced by bending of said movable contact spring, which said normally open fixed contact forms with said movable contact before said normally open contact comes into physical surface-contact with said movable contact, is $5° < \theta < 20°$.

* * * * *